United States Patent [19]

Brandyberry et al.

[11] Patent Number: 4,608,817

[45] Date of Patent: Sep. 2, 1986

[54] SINGLE STRAND METAL CORD AND METHOD OF MAKING

[75] Inventors: Dennis R. Brandyberry, Canton; Kenneth M. Kot, Akron, both of Ohio

[73] Assignee: The Goodyear Tire & Rubber Company, Akron, Ohio

[21] Appl. No.: 728,683

[22] Filed: May 3, 1985

Related U.S. Application Data

[63] Continuation-in-part of Ser. No. 612,514, May 21, 1984, abandoned.

[51] Int. Cl.[4] ..... D07B 3/00; D07B 1/06

[52] U.S. Cl. ..... 57/213; 57/3; 57/13; 57/902

[58] Field of Search ..... 57/210, 212, 213, 214, 57/3, 6, 9, 11, 12, 13, 15, 293, 902

[56] References Cited

U.S. PATENT DOCUMENTS

| | | | |
|---|---|---|---|
| 2,043,130 | 6/1936 | Traugott | 57/15 X |
| 3,005,304 | 10/1961 | Holm | 57/12 |
| 4,125,741 | 11/1978 | Wahl et al. | 57/213 X |
| 4,299,082 | 11/1981 | Tarantola | 57/9 |
| 4,332,131 | 6/1982 | Palsky et al. | 57/213 |
| 4,487,010 | 12/1984 | Chiappetta et al. | 57/213 |

*Primary Examiner*—Donald Watkins

*Attorney, Agent, or Firm*—T. P. Lewandowski

[57] ABSTRACT

A single strand cord of single filaments having similar diameter lay length and direction with at least one core filament positioned with the filaments in the next layer and filaments laid on the cord in one layer positioned with another layer.

26 Claims, 3 Drawing Figures

SINGLE STRAND METAL CORD AND METHOD OF MAKING

This is a continuation in part of application Ser. No. 612,514 filed on May 21, 1984, now abandoned.

The present invention relates to metal cord such as that used to reinforce elastomers, and to a method of making the cord. More particularly, this invention is directed at a single strand cord of compact construction used to reinforce tires.

It is known to manufacture single strand metal cord in a single operation wherein conventional cord is made of filaments having the same diameter twisted together in the same direction and having the same lay length. The cord is said to have a compact cross section which cross section is generally the same over the length of the cord. The filaments in the cross section are arranged in concentric layers in which the filaments are tangential to all the filaments surrounding an individual filament. The single operation produces a cord having a single strand unlike those produced with two or more operations which have two or more strands twisted together. The single strand, compact cord has the advantages of a reduced cord diameter to reduce the thickness of a calendered ply thereby requiring less calender rubber while increasing the potential ends per inch for a given width of ply thereby increasing the ply strength. The uniform cross section is said to give more uniform distribution of the load carried by the cord to each individual filament. The result is a greater breaking load. Further, the cord is also said to have improved fatigue resistance and greater flexibility. Examples of such cord are 19×0.22, 24×0.22 and 27×0.22 where the 19× has a core of one filament or wire of 0.22 millimeter diameter a first layer of 6 wires and a second layer of 12 wires all of the same diameter as the core wire and following the formula N+6+(6+6) where N is the core wire, thus (1+6+12). The 24× and 27× cords have a core of 2 wires a layer of 8 and a layer of 14 wires and a core of 3 wires a layer of 9 and a layer of 15 wires, respectively following the formula N+(N+6)+(N+6+6) where N is the number of core wires, thus (2+8+14) and (3+9+15), respectively.

The present invention is a modification of the above conventional cord which retains the above advantages of the conventional cord and single operation method while providing for a structural interrelationship between the core and a layer and between layers of the cord.

It relates to a single strand metal cord for reinforcing elastomers such as tires which cord consists of filaments of a similar diameter twisted together in the same direction and having the same lay length. The cord has a core of two or more filaments and at least one layer of filaments placed on the core; at least one filament in the core is positioned with the filaments in a first layer next to the core. Further, at least one filament in the first layer may be positioned with the filaments in the second layer, or each additional layer of filaments may have at least one filament from the inner layer positioned with the filaments in each additional layer.

The cord can also be a modification of the above conventional compact cord. For example, 19× cord having a construction of 1+6+12 can be modified by taking a wire from each layer and adding them to the core to give a new construction of 3+5+11. If N is the number of wires in the core of the conventional cord, the new cord can be expressed generally by: (N+L)+5+(5+6), where N=1 and L is the number of layers of wires or filaments laid over the cord. The new, modified, cord has N+L core filaments, 5 filaments in a first layer and 5+6 filaments in a second layer.

Where the conventional cord has a core of N wires greater than one the expression or formula becomes: (N+L)+(N+5)+(N+5+6), where N is an integer greater than 1, again giving the number of wires in the conventional cord core, and L is the number of layers of wires or filaments laid over the core. The new modified cord has N+L core filaments, N+5 filaments in a first layer and N+5+6 filaments in a second layer. For example, 24× cord having a construction of 2+8+14 can be modified by taking a wire from each layer and adding them to the core to give a new construction of (2+2)+(2+5)+(2+5+6) or 4+7+13.

Other new cord constructions can be expressed more generally by: N+(N+X)+(N+X+Y), where N is the number of filaments in the new cord core and is greater than 1, (N+X) is the number of filaments laid on the core filaments where $1<x<6$, and (N+X+Y) is the number of filaments laid on the (N+X) number of filaments where $0<Y<7$. Additional filaments can be laid on as above in accordance with the series N+Y+X+Y, +Y, etc., and fewer number of filaments can be expressed simply by N+(N+X) within the ranges given above for X and Y. An example of a new cord using the above expression would be a 27× where N=5, X=3 and Y=6 to give 5+(5+3)+(5+3+6) or 5+8+14.

A method of making a new cord in a single operation where the cord has one strand of single filaments with similar diameters, lay lengths and lay direction includes the steps of: paying off all of the filaments of the cord to a common twister, applying turns to a first group of the filaments passing through an organizer plate and closing die to form a cure, applying turns to a second group of filaments passing through another organizer plate, passing the core and the second group of filaments through another closing die to form a layer of filaments around the core, and selecting the number of filaments in the core and second group such that at least one filament in the core becomes part of the layer around the core. A further step can include applying turns to additional groups of filaments passing through additional organizer plates and closing dies, in the manner described, to form additional layers of filaments.

The above advantages of the invention will become readily apparent to one skilled in the art from reading the following detailed description of an embodiment of the invention when considered in the light of the accompanying drawings, in which.

Figure 1:
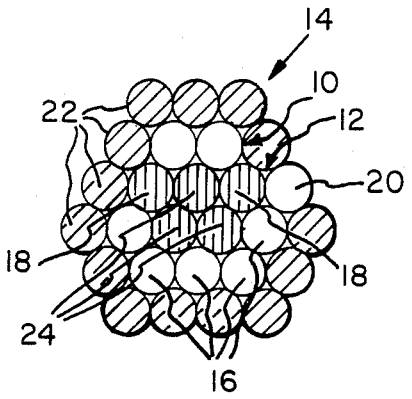
FIG. 1 is a schematic cross sectional view of a cord in accordance with the present invention.
Figure 2:
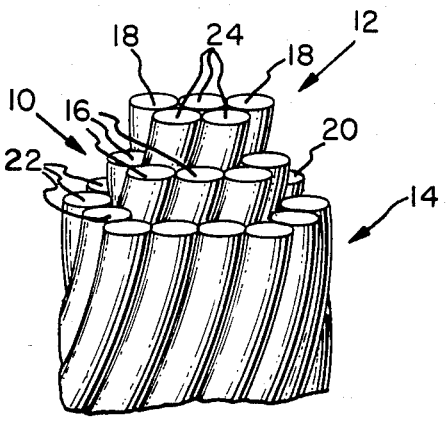
FIG. 2 is a perspective view of the cord in FIG. 1.

Referring to the Figs., FIGS. 1 and 2 illustrate a 27×0.22 cord which if it was a conventional cord would have a construction of 3+9+15 where all of the wires therein would be of 0.22 millimeters diameter having the same lay length and lay direction thus forming a single strand. The cord in FIGS. 1 and 2 has been modified by taking a filament from a first layer 10 surrounding a core 12, and a filament from the second or outer layer 14 so that instead of the conventional 9+15 layers the cord in accordance with this invention has a first, or inner, layer 10, which includes eight filaments 16 laid on the core 12. Two filaments 18 have been added to the core 12 and can be seen to have been positioned with the eight filaments 16. Similarly, one filament 20 of the eight filaments 16 laid on the core 12 can be seen to have been positioned with fourteen filaments 22 laid on the first layer 10. The two filaments 18 added to the core 12 together with core filaments 24 give a total of five, filaments in the core 12, as best seen in FIG. 2, all twisted together.

Figure 3:
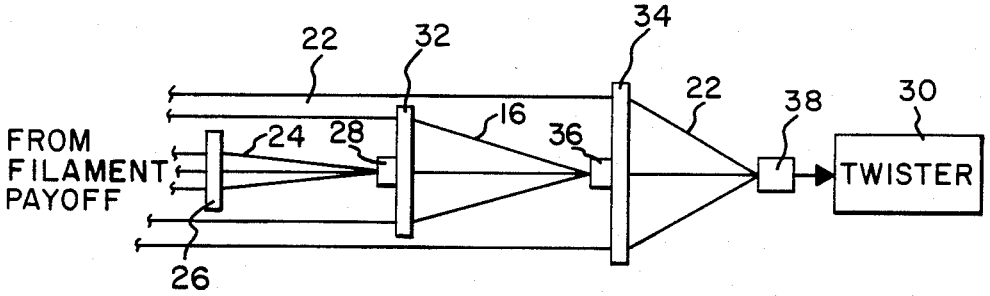
FIG. 3 is a schematic of apparatus for making the cord in FIG. 1.

Referring to FIG. 3 a preferred embodiment illustrates all filaments of the cord coming from a payoff, eg. a bank of individual spools (not illustrated), and a first organizer plate 26 having equally spaced circumferentially distributed holes therein through which the core filaments 24 and 18 pass. The plate 26 may have a similar set of holes spaced radially outwardly for the eight filaments 16 and a still further similar outwardly spaced set of holes for the fourteen filaments 22 where one plate is used. Each set of holes maintains the filaments therein uniformly spaced in a circular pattern. Following the plate 26 the filaments in the core 12 pass through a first closing die 28 where they are gathered and receive a suitable number of turns from the twister 30 which can be a rotating flyer, or any mechanism for apply turns to the filaments. Preferably, the eight filaments 16 pass through the second organizer plate 32 having holes for the eight filaments 16. The fourteen filaments 22 pass through a third organizing plate 34. In each instance the organizing plates 26, 32, 34 allow uniform application of the filaments at the closing die as they are first formed into a core and then laid thereon in stages to form a cord with a generally uniform cross section over its length. Each plate 26, 32, 34 is followed by a closing die such as closing die 28 to gather the filaments from the preceding plate. For the closing dies 36 and 38 following the second and third plates 32 and 34, respectively, the core 12 and previously laid on filaments are passed there through as well to form the finish shape of the cord.

Since the filaments in the core 12 are all twisted together see FIG. 2, when the two filaments 18 of the core 12 are positioned with the filaments 16 of the first layer 10, apparently an interlocking occurs with the filaments 16 in the first layer 10 engaging the core filaments 18 to prevent relative motion between the core 12 and the first layer 10 in the longitudinal direction of the cord. A similar situation occurs between the first and second layers 10 and 14 when a filament 20 from the first layer 10 is positioned with the second layer 14 and the second layer filaments 22 engage the filament 20 of the first layer 10. Further, the two core filaments 18 are moved closer to the surface of the cord and the inner layer filament 20 is moved to the outer layer 14 where direct contact may be made with calender rubber, which is typically applied to the cord, by the inner layer filament 20, while at the same time the core filaments 18 are exposed to greater rubber penetration because the rubber only has to penetrate one layer of filaments as opposes two layers of filaments for the other three core filaments 24. The increase of contact of rubber with filaments and the tying of filaments together by the rubber between them further enhances the interlocking between filaments noted above.

The interlocking characteristic of the new cord, 5+8+14, as compared to conventional compact cord, 3+9+15, was established by lab testing in a core pull-out test. In the test, 10 inch lengths of cord were used as samples which received calender rubber and which rubber was cured on the cord. The cover or outer layer of filaments was stripped back from the inner layer and core which were then subjected to a load pulling the inner layer and core out of the sample and the maximum load during the test was recorded. For the conventional compact cord, 3+9+15, the maximum load ranged from 200 to 500 NT while for the new cord 5+8+14 in accordance with this invention the maximum load ranged from 700 to 1200 NT.

The characteristics noted above for modified 27× are also found in the above noted additional embodiments of 19×(3+5+11) and 24×(4+7+13) in both cases one filament has been taken from each layer of filaments and two filaments added to the core. Further, the principle and characteristics apply to cords of more than two layers where there is positioning of filaments between core and layer and/or between layers. So also to be appreciated is the application of the present invention to the simpler core and single layer construction for example 10× as 3+7. The invention is not to be limited to the examples given but rather applies to all the constructions delimited by the formulas given above and to any cord having the characteristics of interlocking described herein.

While the embodiment of the cord illustrated has filaments preferably of 0.22 millimeters, a range of filament diameters from 0.12 millimeter to 0.4 millimeter is considered suitable, and lay lengths of 8 millimeters to 30 millimeters per turn applied to the cord are also suitable. A lay length of 18 millimeters is preferred for 5+8+14 cord. The cord can be laid in either the S or the Z direction as long as all the filaments are in the same direction. The preferred material for the filaments is steel cord but other metals could be used. Also the cord can be provided with a spiral wrap filament but it is not a necessity.

It is recognized that the ideal structure illustrated in the cord cross section of FIG. 1 is not always achievable and due to, for example, machinery characteristics and/or wear there can in particular be migration of filaments from one layer to another layer periodically over the length of the cord. The transition points in the cord where filaments move from one layer to another of necessity result in a different cross section at that point but once the transition has occurred the structure is basically that illustrated in FIG. 1 and such a cord is within the scope of the present invention.

Further, the scope of the present invention also covers a cord structure where migration is intentionally introduced and/or tolerated to thereby increase the interlocking relationship between the layers. Whether filament migration is intentional or otherwise, it has been found that the movement from one layer to another should occur in 5 to 15 mm distance along the length of the cord because any less than 5 mm is too abrupt a movement causing high stress points and sites for fatigue failure initiation while greater distance up to 15 mm gives a desired line contact between filaments. The frequency of outside filament movement to the inside should be limited to no more than once every 15 mm, but to ensure interlocking of filaments movement should occur at least every 40 mm of length in the cord.

Referring to FIG. 3, it is previously known (see U.S. Ser. No. 554,402 11-23-83 to G. A. Haislet incorporated herein by reference thereto) to limit filament migration by rotating the payoffs for outer filaments, filaments 22, in a direction opposite to the rotation of the twister, and to maintain the cord structure achieved with shaped pulleys (not illustrated) on the twister rotational axis. Also, it is previously known to angle the axial pulleys to roll back on the cord being formed the twist being applied to the cord by the twister 30 to the point of formation i.e., to the die 38.

In the embodiment where filament movement is desired for increased interlocking of layers it has been found that the movement of filaments can be controlled within the above ranges by use of oppositely rotating payoffs on the outer filaments 22 in conjunction with axial pulleys having a bottom of large radius (U shaped pulleys when viewed in quarter section with respect to the pulley surface contacting the cord) at an angle adjusted to the normal right angle of the axis of rotation of the pulley to the direction of travel of the cord. When the first axial pulley of a two for one twister was set at 9 degrees to the perpendicular and the second axial pulley to be contacted by the cord was set at 20 degrees to the perpendicular, roll back of lay length on the cord at the last die 38 was found to be 20 to 25 mm as opposes 18 mm in the final cord. Preferably, the axial pulleys are set at angles of 0° to 30° to the perpendicular to provide a cord roll back of at least 80% of final cord lay length whereby flattening of the cord is prevented and movement of the filaments is controlled. An overtwister could be used in place of angled pulleys to achieve the roll back, and the preferred filament angle of approach to the dies 28, 36, 38 from the organizing plates 26, 32, 34 is in the range of 25 to 30 degrees.

In accordance with the provisions of the patent statutes, the principle and method of making of the product have been explained and what is considered to represent its best embodiment has been illustrated and described. It should, however, be understood that the invention may be practiced otherwise than as specifically illustrated and described without departing from its spirit or scope.

We claim:

1. A metallic cord for reinforcing elastomers having single filaments of similar diameter, lay length and lay direction comprising: a plurality of filaments laid on a core of two or more filaments which core filaments are twisted about each other, at least one filament in the core being in a layer of filaments formed by it and the plurality of filaments, the layer of filaments enclosing the remainder of core filaments.

2. The cord defined in claim 1 further including at least one other layer of filaments, comprising at least one filament of the plurality of filaments around the core and a further plurality of filaments enclosing the layer of filaments around the core.

3. The cord defined in claim 1 further including additional layers of additional filaments with at least one filament from a previous inner layer forming with a portion of the additional filaments an additional layer enclosing the inner layer.

4. A metallic cord of single filaments having a core and additional single filaments all of a similar diameter, lay length and lay direction comprising: a core of N number of filaments twisted about each other and N+X number of filaments laid on the core filaments, at least one filament of the core located a distance from the center of the cord equal to the distance from the center of the cord to the N+X number of filaments laid thereon, all of the filaments in the layer touching the group formed by the remainder of the core filaments where $N>1$ and $1<x<6$.

5. The cord defined in claim 4 further including N+X+Y number of filaments laid on the N+X number of filaments where $0<Y<7$.

6. The cord defined in claim 5 further including still further additional filaments being laid on according to the series N+X+Y, N+X+Y+Y, . . . .

7. The cord defined in claims 5 or 11 wherein $N=5$, $X=3$ and $Y=6$.

8. The cord defined in any one of claims 1–3, 4–6 wherein the filament diameter is between 0.12 mm to 0.40 mm.

9. The cord defined in claim 8 wherein the filament diameter is 0.22 mm.

10. The cord defined in any one of claims 1–3, 4–6 wherein the lay length of the cord is between 8.0 mm/turn to 30.00 mm/turn.

11. The cord defined in claim 10 wherein the lay length of the cord is 18.0 mm.

12. A tire made of layers elastomer reinforced with cord as defined in any one of claims 1–3, 4–6.

13. A method of making a metallic cord in a single operation having single filaments with similar diameters, lay lengths and lay direction resulting from twisting all of the filaments with a single twister comprising the steps of:

paying off all of the filaments of the cord to the single twister, gathering a first group of the filaments to form a core, first twisting filaments of the core about each other, second applying turns to a second group of filaments to lay them on the core filaments with at least one filament in the core located a distance from the center of the cord equal to the distance from the center of the cord to each of the second group of filaments.

14. The method defined in claim 13 including the step of applying turns to additional groups of filaments to lay them on the second group of filaments and sequentially additional groups of filaments to form additional layers of filaments.

15. The method defined in claim 14 including the step of forming all of the layers of filaments such that at least one filament in each preceding layer is located a distance from the center of the cord equal to the distance from the center of the cord to each of the filaments in the next layer.

16. A method of making a metallic cord in a single operation having single filaments with similar diameters, lay lengths and lay direction comprising the steps of:

first twisting N number of filaments about each other to form a core where $N>1$; and applying the same turns to N+X number of filaments to lay the filaments on the core where $1<X<6$ to form a cord with at least one filament in the core being located a distance from the center of the cord equal to the distance from the center of the cord to each of the N+X number of filaments.

17. The method defined in claim 6 including the step of applying the same turns to N+X+Y number of filaments to place the filaments on the N+X number of filaments where $0<Y<7$.

18. The method defined in claim 17 further including the still further step of additional filaments being placed on to the cord according to the series N+X+Y, N+X+Y+Y, . . . .

19. The method defined in claims 17 or 18 wherein N=5, N=3 and Y=6.

20. The method defined in one of claims 13–19 including the additional steps of:

initially imparting turns to the outer most filaments in a direction opposite the turns applied to the cord, and rolling back the turns on the cord from inside the flyer to a cord forming point outside of the flyer to control the migration of filaments from the outer layer inwardly.

21. The method defined in claim 20 wherein the filament migration is controlled to occur in 5 to 15 mm distance along the length of the cord.

22. The method defined in claim 20 wherein the filament migration frequency of occurrence should be between 15 mm and 40 mm in length of cord for each occurrence.

23. The method defined in claim 20 wherein the step of rolling back the turns on the cord includes twisting the cord by setting the rotational axes of axial pulleys guiding the cords at 0° to 30° to the perpendicular of the cord direction of travel.

24. The method defined in claim 23 wherein the roll back is at least 80% of final cord lay length.

25. A metallic cord for reinforcing elastomers having single filaments of similar diameter, lay length and lay direction comprising at least two layers of filaments, one of which may be a core, one layer being internal to the other layer to thereby form inner and outer layers, at least one filament in an outer layer displaced into an inner layer and vice versa with a frequency of every 15 mm to 40 mm over the length of the cord.

26. The metallic cord defined in claim 25 further defined by the length of the filament displacement being controlled to occur in 5 to 15 mm distance along the length of the cord.

* * * * *